US010271621B2

(12) United States Patent
Froehlich et al.

(10) Patent No.: US 10,271,621 B2
(45) Date of Patent: Apr. 30, 2019

(54) GEMSTONE WITH A CHATON CUT

(75) Inventors: Maik Froehlich, Kundl (AT); Karlheinz Eder, Buch in Tirol (AT); Guenther Blasbichler, Innsbruck (AT); Markus Sauer, Mils (AT)

(73) Assignee: D. Swarovski KG, Wattens (AT)

( * ) Notice: Subject to any disclaimer, the term of this patent is extended or adjusted under 35 U.S.C. 154(b) by 0 days.

(21) Appl. No.: 13/411,892

(22) Filed: Mar. 5, 2012

(65) Prior Publication Data

US 2012/0227444 A1 Sep. 13, 2012

(30) Foreign Application Priority Data

Mar. 7, 2011 (AT) ..... 300/2011

(51) Int. Cl.
*A44C 17/00* (2006.01)

(52) U.S. Cl.
CPC ..... *A44C 17/001* (2013.01); *A44C 17/007* (2013.01)

(58) Field of Classification Search
CPC .... A44C 17/001; A44C 17/008; A44C 17/007
USPC ..... 63/32
See application file for complete search history.

(56) References Cited

U.S. PATENT DOCUMENTS 6,422,039 B2 * 7/2002 Bamminger et al. ..... 63/32
D483,686 S * 12/2003 Bamminger ..... D11/90
6,705,114 B2 * 3/2004 Steiner ..... 63/32
D691,916 S * 10/2013 Stuchlik ..... D11/90
2002/0162356 A1 11/2002 Wueste
2005/0050921 A1 * 3/2005 Katz et al. ..... 63/32
2009/0038341 A1 2/2009 Zheng

FOREIGN PATENT DOCUMENTS

| | | |
|---|---|---|
| CN | 85102401 | 1/1987 |
| CN | 1593285 | 3/2005 |
| CN | 201153610 | 11/2008 |
| CN | 101721021 | 6/2010 |
| EP | 2 179 672 | 4/2010 |
| WO | 2006/036937 | 4/2006 |
| WO | 2010/035741 | 4/2010 |

OTHER PUBLICATIONS

Austrian Search Report dated Dec. 28, 2011 in Austrian Patent Application No. A 300/2011.

* cited by examiner

*Primary Examiner* — Jack W Lavinder

(74) *Attorney, Agent, or Firm* — Stevens & Showalter, LLP

(57) ABSTRACT

A gemstone with a chaton cut has tapering facets of a crown adjoin a flat table all the way round inclined relative to the table. The facets extend as far as a rondist at which the gemstone has the largest transverse dimension. A pavilion of facets, preferably terminating at a point, adjoins below the rondist. The gemstone is at least partially made of glass, and the crown angle ($\alpha$) is between 40.5° and 42.5°.

20 Claims, 5 Drawing Sheets

GEMSTONE WITH A CHATON CUT

BACKGROUND OF THE INVENTION

(1) Field of the Invention

The invention relates to a gemstone with a chaton cut.

(2) State of the Art

In order to improve the brilliance and other optical properties of a facetted cut gemstone, over the course of time many different cuts have been developed that differ on the one hand by the number of facets and on the other hand by the mutual geometrical positional relationships of the facets.

In particular for the chaton sector the so-called oktant or xilion cut (e.g. Swarovski stones A1200 and A1028) has in the past become established in the market, since these cuts are considered to be aesthetically pleasing and can be satisfactorily reproduced.

Important parameters for the evaluation of a gemstone are the so-called "fire" and "light return", which is based on the numerous internal light reflections. These light reflections are produced at the individual facets, which are in special angular relationships to one another characterizing the respective cut. The cut and the material of a gemstone are thus decisive for the resultant fire and light return.

The light return value specifies how much light from a predefined solid angle range that is incident on the gemstone is directed back to the observer in a relatively narrow (aperture angle 3°) solid angle range substantially along the axis of symmetry of the stone.

A further important feature for evaluating the brilliance of a gemstone is the fire. Fire denotes the property of a gemstone to split the incident white light into its spectral components. The expression of this property depends on the material (dispersion) and also on the cut.

A gemstone with a chaton cut has a crown, also termed upper part, with a defined number of side facets and a middle flat table, as well as a pavilion, also termed lower part, with a defined number of facets. The end of the gemstone remote from the table can be formed as a point or as a rounded point in the form of a so-called culet. A so-called rondist, also called a girdle, (circumferential edge) can be arranged between the upper part and lower part. The gemstone can be cut symmetrically or asymmetrically.

SUMMARY OF THE INVENTION

The object of the invention is to further improve the aesthetic impression of a gemstone with a chaton cut by optimizing the optical parameters, in particular the fire and light return.

This is achieved by a gemstone having the features of a chaton cut in which tapering facets of a crown adjoin a flat table all the way round inclined relative to the table. The facets extend as far as a girdle at which the gemstone has the largest transverse dimension. A pavilion of facets, which preferably terminate at a point, adjoins below the girdle. The gemstone is made of glass and has a crown angle (a) between 40.5° and 42.5°. Further, the angle between the girdle plane and the crown facets that adjoin the table by way of a broad side is between 33.5° and 35.5°.

On account of the fact that the gemstone has a chaton cut, in which the crown angle ($\alpha$) is between 40.5° and 42.5°, this surprisingly produces a particularly high light return with at the same time a high fire. The scintillation (sparkling effect that occurs on moving the gemstone) and the brilliance of the gemstone are exhibited extremely effectively.

The crown angle is that angle which in a side view of the gemstone is enclosed between the lateral boundary line of the crown and the rondist or girdle plane, this boundary line being generated by an orthogonal projection of a crown facet onto a plane containing the longitudinal axis of the gemstone.

The rondist or girdle plane plane is that plane which is arranged parallel to the table and in which the gemstone has the largest cross-sectional dimension. The rondist plane is aligned perpendicular to the longitudinal direction of the gemstone.

The light return and the fire can be measured, as is described further hereinbelow for example with the aid of FIGS. 5 and 6. Instead of an actual measurement the measurement can also be computationally simulated on the basis of the geometry and material of the gemstone.

Further advantageous modifications of the invention are defined in the dependent claims.

It has been found that particularly preferred crown angle ranges ($\alpha$) lie between 41.75° and 42.25°. The crown angle ($\alpha$) is most particularly preferably 41.95°.

In a preferred embodiment of the invention the pavilion angle ($\beta$) is between 39.5° and 41.5°, preferably between 40.5° and 41.0° and most particularly preferably is 40.73°.

The pavilion angle is that angle which in a side view of the gemstone is enclosed between the lateral boundary line of the pavilion and the rondist plane, this boundary line being generated by an orthogonal projection of a pavilion facet onto a plane containing the longitudinal axis of the gemstone.

Although the gemstone according to the invention may preferably be made of a glass, a gemstone of natural or synthetic precious or semi-precious stone or synthetic material with the chaton cut according to the invention is also possible.

The crown of the gemstone, which is also known as the upper part, has a table on which eight crown facets adjoin in each case via a broad side. In one embodiment of the invention the angle between these crown facets and the rondist plane is between 33.5° and 35.5°, (preferably between 34.25° and 34.75° and most particularly preferable is 34.52°).

In addition the crown has eight further crown facets, which in each case adjoin the rondist via a broad side. In one embodiment of the invention the angle between these crown facets and the rondist plane is between 40.5° and 42.5° (preferably between 41.75° and 42.25° and most particularly preferably is 41.95°). The orthogonal projection of the last-mentioned crown facets generates the crown angle.

The pavilion, also known as the lower part, has at least 16 pavilion facets, which terminate in the form of a point or a culet on the end remote from the table. In this manner, in one embodiment eight pavilion facets have a point that is arranged in the direction of the rondist, while eight pavilion facets have a broad side that is adjacent to the rondist. The end of this pavilion facet remote from the broad side terminates in a point and is directed away from the rondist. These pavilion facets adjoining the rondist via the broad side have in one embodiment an angle between 39.5° and 41.5° relative to the rondist plane, preferably between 40.5° and 41° and most particularly preferably 40.73°. The orthogonal projection of the last-mentioned pavilion facets generates the pavilion angle.

In one embodiment of the invention the angle between the rondist plane and those pavilion facets that have a point adjoining the rondist or that is arranged in the direction of the rondist, is between 35.0° and 37.0° (preferably between 36.0° and 36.5°, and most particularly preferably is 36.28°.

BRIEF DESCRIPTION OF THE DRAWINGS

Further details and advantages of the present invention are described in more detail hereinafter with the aid of the description of the figures and with reference to the drawings, in which.

DETAILED DESCRIPTION OF THE PREFERRED EMBODIMENT

Figure 1A:
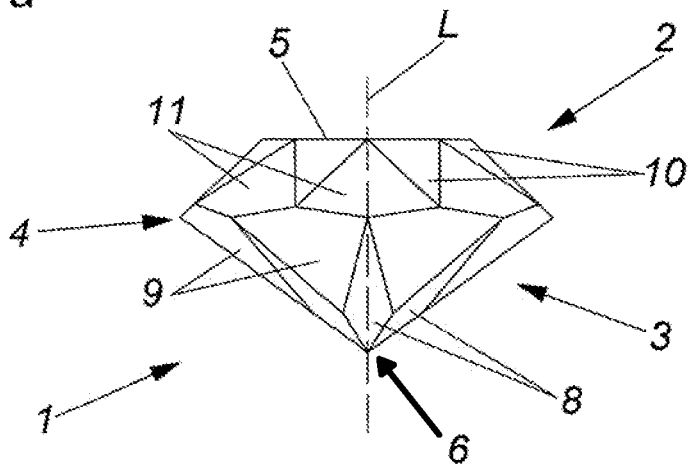
FIGS. 1*a* to 1*c* are respectively a side view, a plan view and a view from below of a gemstone according to the invention.

FIG. 1*a* shows a gemstone 1 according to the invention in a side view. The rondist or girdle 4, which separates the crown 2, also termed upper part, from the pavilion 3, also termed lower part, can be recognized. The rondist 4 is that region of the largest cross-sectional dimension of the gemstone 1. The symmetry axis (longitudinal axis L) of the gemstone is also schematically illustrated.

The pavilion 3 has two types of pavilion facets 8, 9 (two-layer cut). In this case eight pavilion facets 9 have a broad side via which they adjoin the rondist 4. The remaining pavilion facets 8 have a point that in each case adjoins the rondist 4.

The crown 2 also has 16 facets 10 and 11, as well as a flat table 5, which is aligned parallel to the rondist plane 7 and perpendicular to the longitudinal axis L.

Eight crown facets 11 adjoin the rondist in each case via a broad side and have a point that is aligned in the direction of the table 5. Eight further crown facets 10 adjoin the table 5 in each case via a broad side (two-layer cut).

Figure 1B:
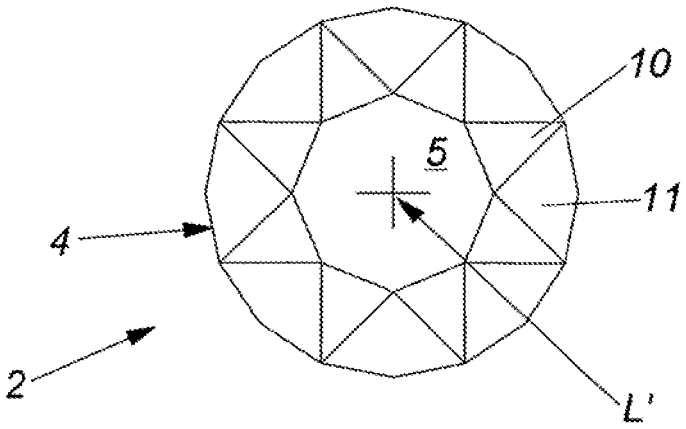

FIG. 1*b* shows a plan view of the crown 2 of the gemstone 1. The symmetry of the gemstone 1 can be recognized by the schematically illustrated coordinate cross on the table 5. The longitudinal axis L runs through the center of the coordinate cross.

Figure 1C:
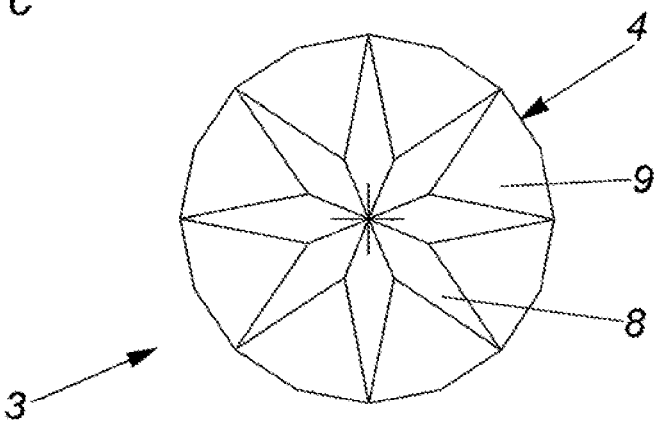

FIG. 1*c* shows a view from below the pavilion 3 of the gemstone 1. A further coordinate cross to illustrate the symmetry of the gemstone 1 is symbolically shown at the point 6, which is formed by the mutually adjoining pavilion facets 8.

Figure 2:
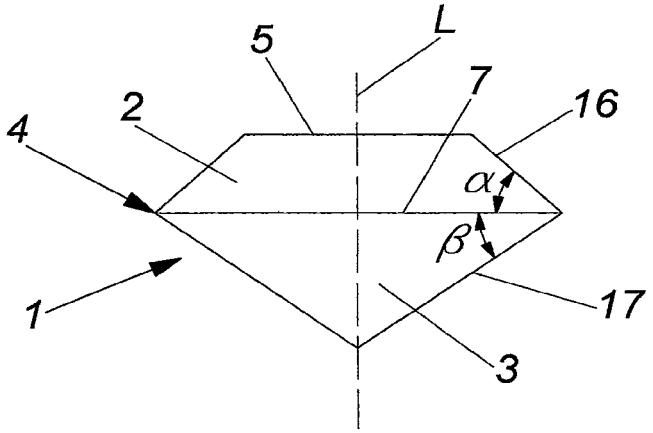
FIG. 2 is a schematic representation of the definition of the crown angle and pavilion angle, FIGS. 3*a* and 3*b* compare respectively a gemstone of the prior art (Swarovski A1200) and a gemstone according to the invention by means of a schematic representation of ray paths.

FIG. 2 shows a schematic representation to illustrate the crown angle α, which is formed between the rondist plane 7 and the lateral boundary line 16 of the crown 2, while the pavilion angle β is formed between the lateral boundary line 17 of the pavilion 3 and the rondist plane 7.

Figure 3A:
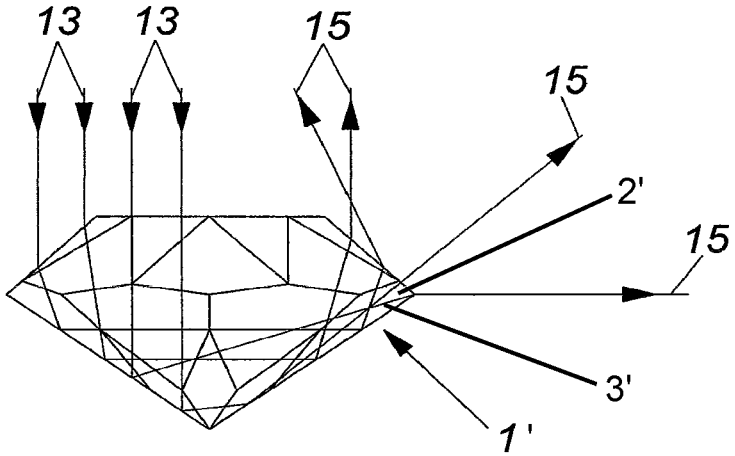

FIG. 3*a* shows a gemstone 1' with a chaton cut of the prior art (Swarovski A1200). The light rays 13 entering the gemstone are only partially reflected back in the direction of view at the pavilion 3' on account of the angle with which the pavilion facets are cut, in particular on account of the crown angle and the pavilion angle. A proportion of the rays is refracted laterally or is scattered in the form of the ray 15. The light return value is reduced.

Figure 3B:
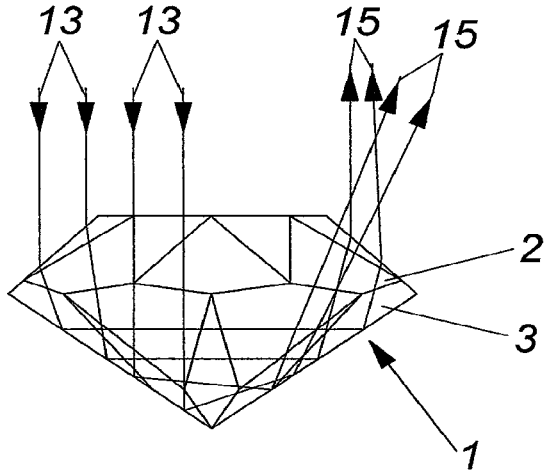

FIG. 3*b* shows the same representation for a gemstone 1 according to the invention. On account of the special geometrical arrangement of the different facets and of the crown angle α and pavilion angle β, the light return is significantly improved, since the majority of the rays are totally reflected in the region of the pavilion 3, so that virtually all the light rays 13 entering the crown 2 are reflected back to the observer, after possibly undergoing multiple reflection, in the form of light rays 15 leaving the crown 2.

The following table shows the differences of the known gemstone A1200 of the applicant according to the prior art, compared to a gemstone "I021" according to an embodiment of the invention.

Figure 4:
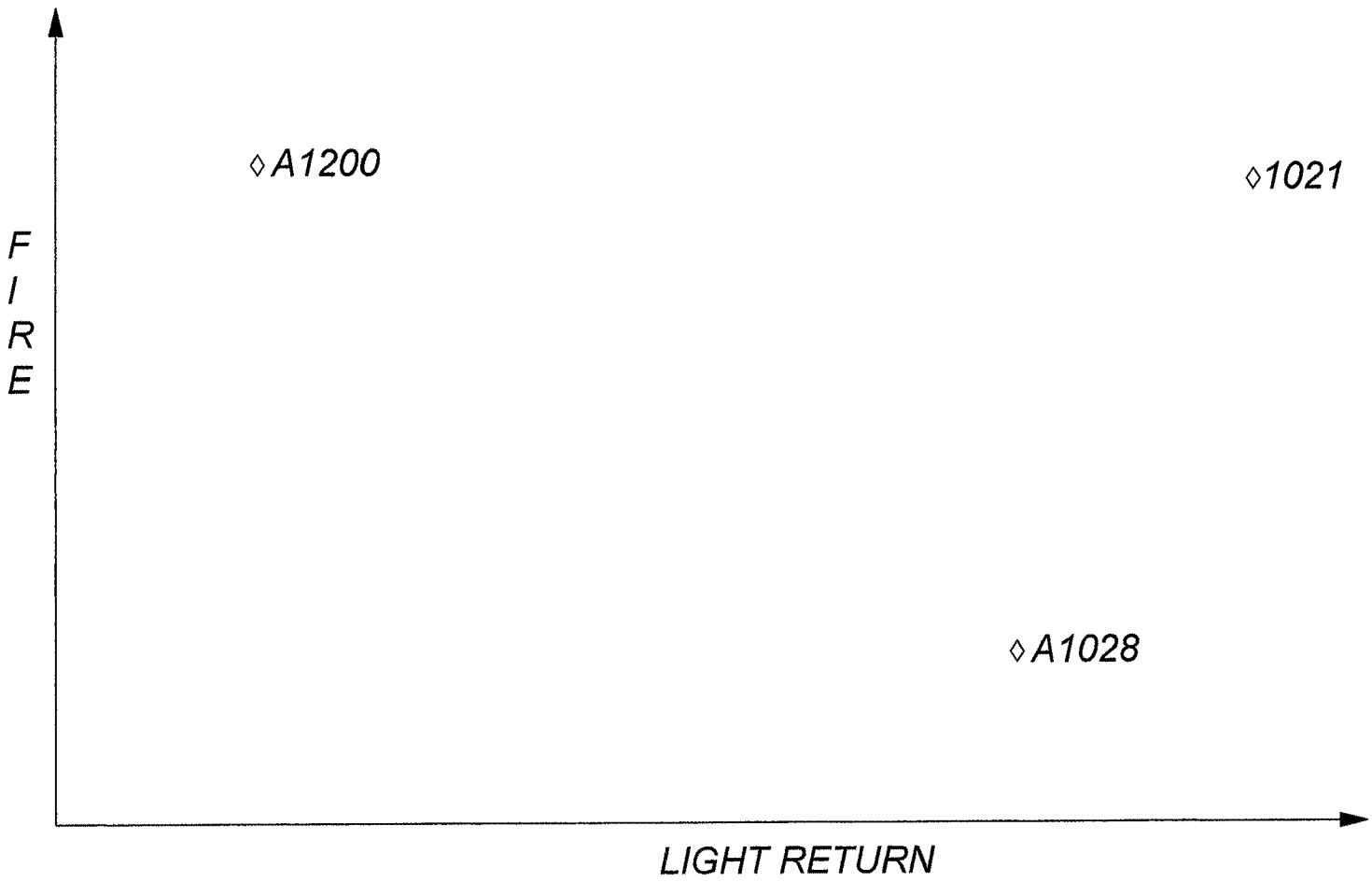
FIG. 4 is a light return/fire diagram.

FIG. 4 shows the position of this gemstone I021 according to the invention in the so-called light return/fire diagram. It can be seen that the gemstone according to the invention has simultaneously high light return values and high fire values compared to the prior art A1200 and A1028, which is another gemstone of the applicant, and is thus superior to the prior art as regards the optical properties and the aesthetic impression.

Figure 5:
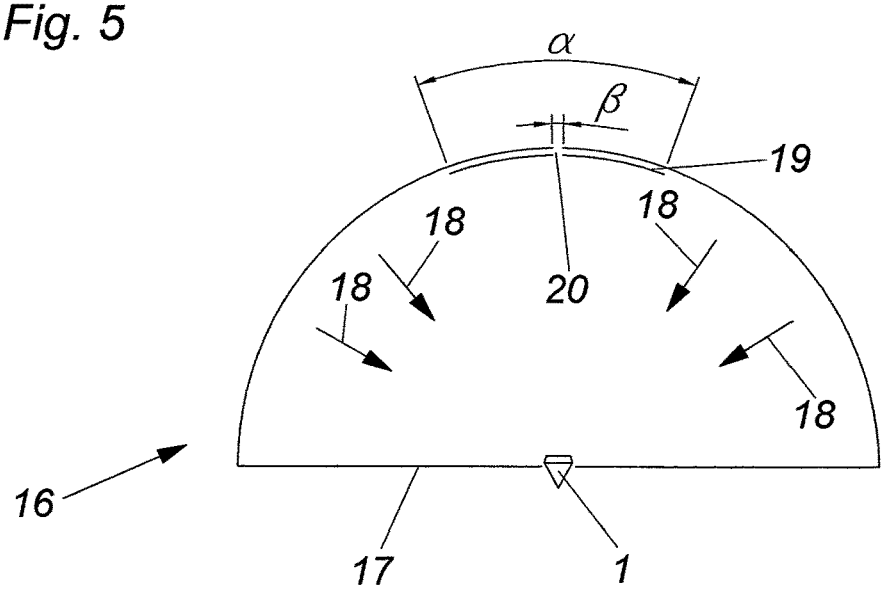
FIG. 5 is a schematic representation of the measurement arrangement for measuring the light return.

FIG. 5 shows in a schematic view a measurement arrangement for measuring the light return of a gemstone. A gemstone 1 arranged in a center of a base circle 17 of the hemisphere 16 is illuminated by light rays 18 from a hemispherical illumination arrangement, so that the crown 2 of the gemstone 1 is illuminated with white, diffuse light, the light rays hemispherically striking the gemstone 1 and being reflected from the gemstone. The base circle 17 is blacked out except for a recess for the gemstone 1, so that no light is incident on the gemstone 1 from underneath the base circle 17. A region 19 of the hemisphere 16, which lies directly opposite the gemstone 1 and has an aperture angle α of 46°, is likewise blacked out. From this region too no light is incident on the gemstone 1. The region 19 has a recess 20 with an aperture angle β of 3°. This recess 20 serves as a narrow measurement field for a detector. A detector measuring a stream of light can thus be arranged above the recess 20.

Instead of this arrangement, the respective light-specific values, such as for example the brightness in the region of this recess 20, can be calculated in a computer simulation.

The amount of light reflected upwardly from the gemstone 1 represents a mean value over almost all possible illumination arrangements and thus provides a quantitative measure for the light return of the gemstone 1. The reflections take place at different facets, so that light is reflected back to the recess directly on first striking the gemstone, but also after multiple internal reflections.

Figure 6:
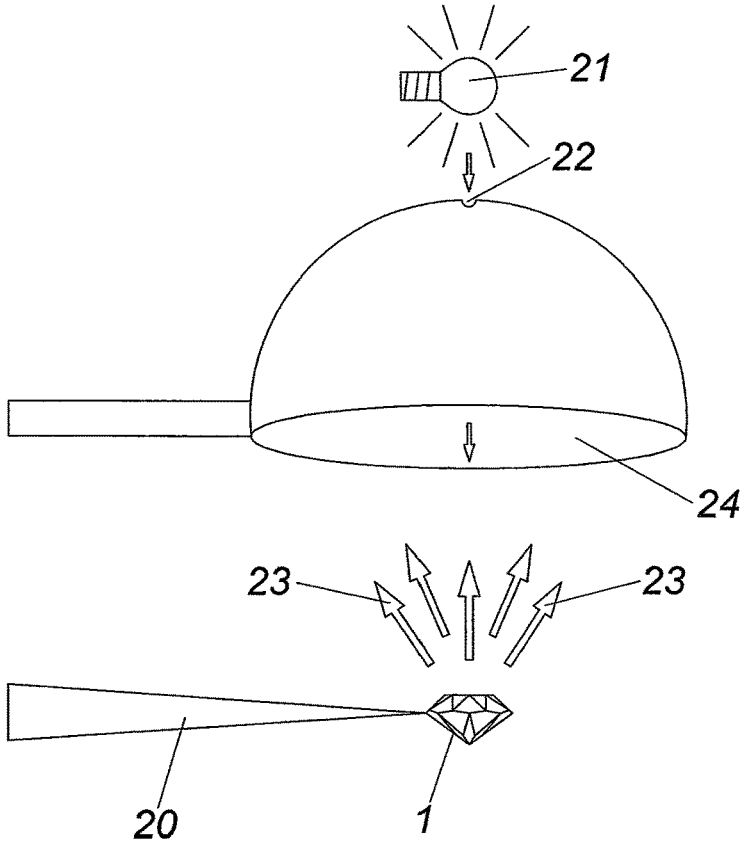
FIG. 6 is a schematic representation of the measurement arrangement for measuring the fire.

FIG. 6 shows a measurement arrangement for the fire value. The gemstone 1 held by a holder 20 is illuminated through the opening 22 in the direction of its main axis with a directed beam from the light source 21. The back-scattered light from the gemstone 1 is recorded in color on a measurement field 24. The product values from the saturation and illumination intensity of the light points collected in the measurement field 25 are summed and thus give the numerical value for the fire.

Figure 7A:
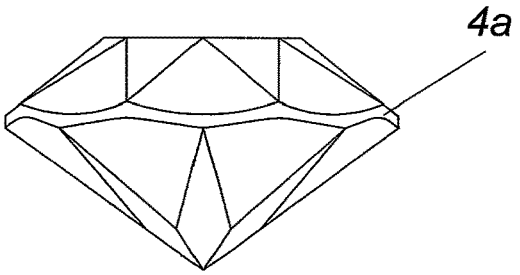
FIGS. 7*a* to 7*c* show a further embodiment of a gemstone according to the invention in a side view.
Figure 7B:
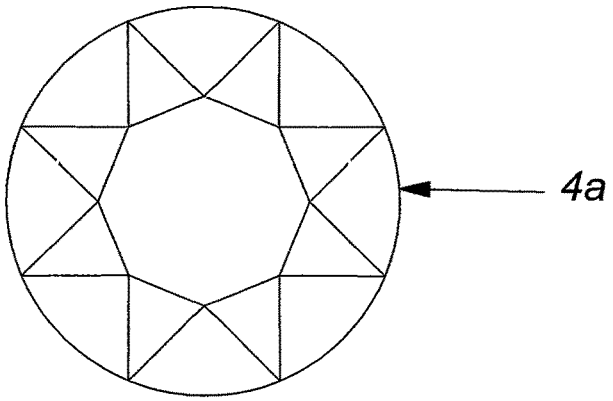
Figure 7C:
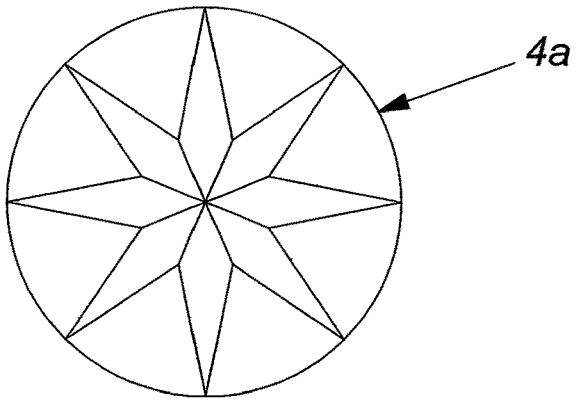

FIGS. 7*a* to 7*c* show in a schematic side view a gemstone according to a further embodiment of the invention, similar to FIG. 1*a*, though in this case the stone in contrast to the stone of FIG. 1*a* has a pronounced circumferential edge 4*a* (rondist), which in plan view encircles the gemstone.

The invention is obviously not restricted to the illustrated embodiments, and in particular the number of facets can vary, in contrast to the illustrated gemstone, which has in each case 8+ facets on both the table and pavilion, though other combinations of facets can also be employed, for example 6+6, 10+10 or 12+12 facets. Odd numbers of facets are also possible. Also, the number of facets between the crown on the one hand and pavilion on the other hand do not have to match.

In the illustrated embodiment the crown as well as the pavilion contains two different cutting angles (two-layer cut). In principle single-layer and multiple layer gemstones are also possible.

Glass is used as preferred material, preferably with a refractive index between 1.50 and 1.60, and most preferably 1.55. Other materials, in particular natural stones, are however also feasible and possible.

The invention claimed is:

1. An artificial gemstone with a chaton cut comprising:

a crown having a flat table and tapering facets, said tapering facets adjoining said flat table all the way around said table and being inclined relative to said table;

said tapering facets of said crown extending as far as a girdle of the gemstone at which the gemstone has a largest transverse dimension, wherein said tapering facets of said crown comprise a first set of crown facets each adjoining said flat table with a tapered end of each of said first set of crown facets and a second set of crown facets each adjoining said flat table along a broad side of each of said second set of crown facets;

said first set of crown facets being inclined with respect to a girdle plane at an angle between 40.5° and 42.5°;

said second set of crown facets being inclined with respect to said girdle plane at an angle between 33.5° and 35.5°;

a pavilion of facets, each facet of said pavilion of facets adjoining said girdle from below said girdle, said pavilion of facets having only:

a first set of pavilion facets each extending from a point of said gemstone toward said girdle to adjoin said girdle from below at a single point, wherein an angle between said girdle plane and said first set of pavilion facets is between 35.0° and 37.0°, and a second set of pavilion facets each adjoining said girdle along a broad side, wherein an angle between said girdle plane and said second set of pavilion facets is between 40.5° and 41.0°; and wherein said artificial gemstone is made of glass.

2. The artificial gemstone according to claim 1, wherein said angle of said first set of crown facets with respect to said girdle plane is a crown angle and is between 41.75° and 42.25°.

3. The artificial gemstone according to claim 2, wherein said crown angle is 41.95°.

4. The artificial gemstone according to claim 3, wherein said angle between said girdle plane and said second set of crown facets is between 34.25° and 34.75°.

5. The artificial gemstone according to claim 2, wherein said angle between said girdle plane and said second set of crown facets is between 34.25° and 34.75°.

6. The artificial gemstone according to claim 1, wherein said angle between said girdle plane and said second set of crown facets is between 34.25° and 34.75°.

7. The artificial gemstone according to claim 1, wherein said angle between said girdle plane and said second set of crown facets is 34.52°.

8. The artificial gemstone according to claim 1, wherein said angle between said girdle plane and said first set of pavilion facets is between 36.0° and 36.5°.

9. The artificial gemstone according to claim 1, wherein said angle between said girdle plane and said first set of pavilion facets is 36.28°.

10. The artificial gemstone according to claim 1, wherein said angle between said girdle plane and said second set of pavilion facets is 40.73°.

11. The artificial gemstone according to claim 1, wherein said first set of crown facets consists of six, eight, ten or twelve facets.

12. The artificial gemstone according to claim 1, wherein said second set of crown facets consists of six, eight, ten or twelve facets.

13. The artificial gemstone according to claim 1, wherein said first set of pavilion facets consists of six, eight, ten or twelve facets.

14. The artificial gemstone according to claim 1, wherein said second set of pavilion facets consists of six, eight, ten or twelve facets.

15. The artificial gemstone according to claim 1, wherein:

said first set of pavilion facets extend between said girdle and said point of said gemstone; and said second set of pavilion facets stop short of said point of said gemstone.

16. The artificial gemstone according to claim 1, wherein said single point at which each of said first set of pavilion facets adjoins said girdle is aligned with a midline of said broad side of a respective one of said crown facets in said first set of crown facets.

17. The artificial gemstone according to claim 1, wherein said second set of crown facets each adjoin said girdle with a tapered end, said tapered end being aligned with a midline of said broad side of a respective one of said facets in said second set of pavilion facets.

18. An artificial gemstone with a chaton cut comprising:

a crown having a flat table and tapering facets, said tapering facets adjoining said flat table all the way around said table and being inclined relative to said table;

said tapering facets of said crown extending as far as a girdle of the gemstone at which the gemstone has a largest transverse dimension, wherein said tapering facets of said crown comprise a first set of crown facets each adjoining said flat table with a tapered end of each of said first set of crown facets and a second set of crown facets each adjoining said flat table along a broad side of each of said second set of crown facets;

said first set of crown facets being inclined with respect to a girdle plane at an angle between 40.5° and 42.5°;

said second set of crown facets being inclined with respect to said girdle plane at an angle between 33.5° and 35.5°;

a pavilion of facets each adjoining said girdle from below said girdle and having only:

a first set of pavilion facets each extending from a point of said gemstone to said girdle, wherein an intersection between an edge of said girdle and each facet in said first set of pavilion facets forms a single point and an angle between said girdle plane and said first set of pavilion facets is between 35.0° and 37.0°, and a second set of pavilion facets each adjoining said girdle along a broad side, wherein an angle between said girdle plane and said second set of pavilion facets is between 40.5° and 41.0°; and wherein said artificial gemstone is made of glass.

19. An artificial gemstone with a chaton cut comprising:

a crown having a flat table and tapering facets, said tapering facets adjoining said flat table all the way around said table and being inclined relative to said table;

said tapering facets of said crown extending as far as a girdle of the gemstone at which the gemstone has a largest transverse dimension, wherein said tapering facets of said crown comprise a first set of crown facets each adjoining said flat table with a tapered end of each of said first set of crown facets and a second set of crown facets each adjoining said flat table along a broad side of each of said second set of crown facets;

said first set of crown facets being inclined with respect to a girdle plane at an angle between 40.5° and 42.5°;

said second set of crown facets being inclined with respect to said girdle plane at an angle between 33.5° and 35.5°;

a pavilion of facets, each facet of said pavilion of facets adjoining said girdle from below said girdle, said pavilion of facets having only:

a first set of pavilion facets each extending from a point of said gemstone toward said girdle to adjoin said girdle from below at a single point, wherein an angle between said girdle plane and said first set of pavilion facets is between 35.0° and 37.0°; and a second set of pavilion facets each adjoining said girdle along a broad side, wherein an angle between said girdle plane and said second set of pavilion facets is between 40.5° and 41.0°; and wherein said artificial gemstone is made of glass having a refractive index between 1.50 and 1.60.

20. The artificial gemstone according to claim 19, wherein the glass has a refractive index of 1.55.

* * * * *